US006190213B1

(12) United States Patent
Reichart et al.

(10) Patent No.: US 6,190,213 B1
(45) Date of Patent: Feb. 20, 2001

(54) CONTACT ELEMENT SUPPORT IN PARTICULAR FOR A THIN SMART CARD CONNECTOR

(75) Inventors: Manfred Reichart, Weinsberg; Gerhard Braun, Bitzfeld, both of (DE)

(73) Assignee: Amphenol-Tuchel Electronics GmbH (DE)

( * ) Notice: Under 35 U.S.C. 154(b), the term of this patent shall be extended for 0 days.

(21) Appl. No.: 09/343,554

(22) Filed: Jun. 30, 1999

(30) Foreign Application Priority Data

Jan. 7, 1998 (DE) ..... 198 29 467

(51) Int. Cl.[7] ..... H01R 13/405
(52) U.S. Cl. ..... 439/736; 439/331
(58) Field of Search ..... 439/630, 862, 439/736, 331, 71, 79

(56) References Cited

U.S. PATENT DOCUMENTS 4,461,524 * 7/1984 McGhee .

5,320,552 * 6/1994 Reichardt et al. ..... 439/331

* cited by examiner

*Primary Examiner*—Khiem Nguyen

(74) *Attorney, Agent, or Firm*—Blank Rome Comisky & McCauley, LLP

(57) ABSTRACT

A contacting apparatus comprising: a contact element support and fixedly mounted in said contact element support at least one contact element, wherein A) said contact element comprises: a contact cusp portion, a mounting section adapted to be enclosed by said contacting element support, and a contacting portion, said mounting section forming a step adapted to be located within said contact element support; and B) said contact element support being designed such, that it encloses said contact element only in locations where a load is generated by a contacting force exerted onto said contact cusp portion.

8 Claims, 2 Drawing Sheets

FIG. 1
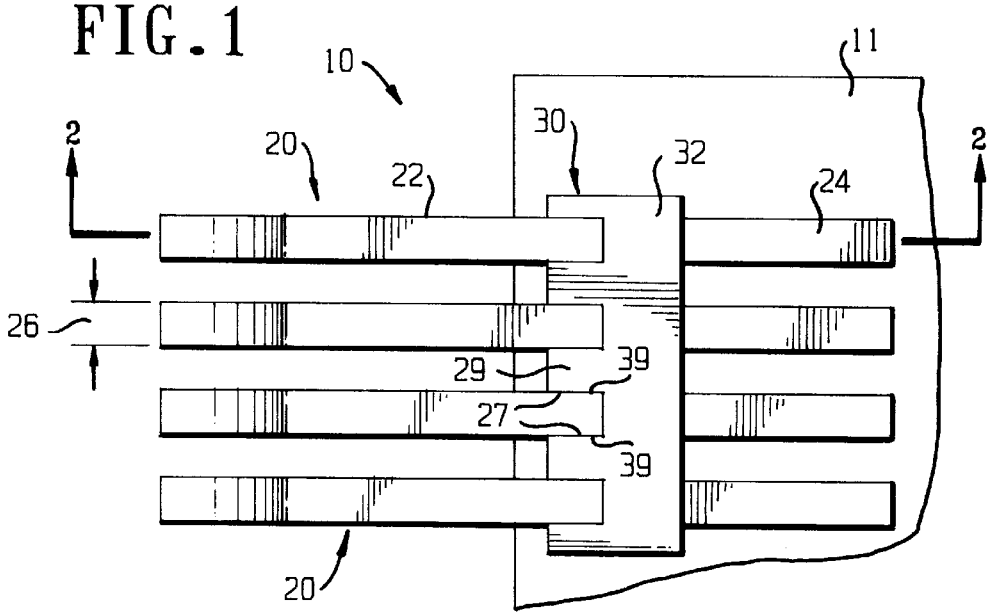
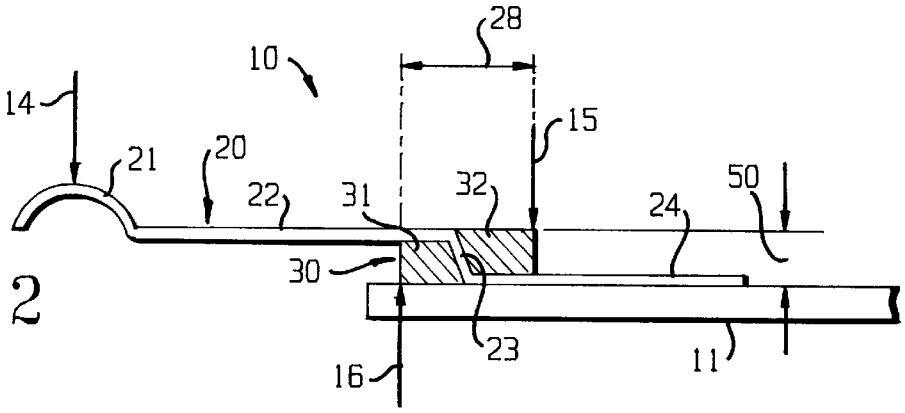
FIG. 2
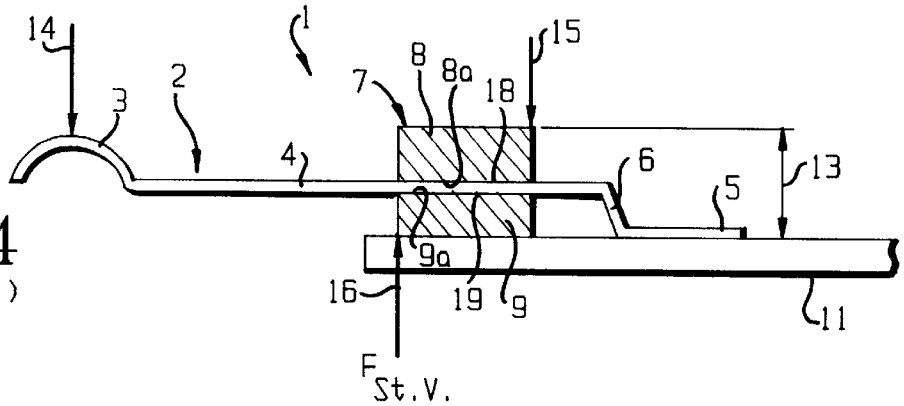
FIG. 4
(PRIOR ART)

CONTACT ELEMENT SUPPORT IN PARTICULAR FOR A THIN SMART CARD CONNECTOR

TECHNICAL FIELD

This invention relates to a contacting apparatus comprising a contact element support and contact elements mounted in that contact element support. Preferably the invention relates to a contact element support with the contact elements being mounted in said contact element support at the time it is being injection molded.

BACKGROUND ART

A known contacting apparatus to which the present invention relates, is shown in FIG. 4. Said contacting apparatus comprises a contact element support which encloses a mounting section or portion of each of said contact elements so that the contact forces occurring at the time the contact elements are in contact engagement are taken-up or balanced. The minimum thickness of the contact element support is the sum of the thickness of the material below the contact element, the thicknesses of the material of the contact element, and the thickness of the material above the contact element. It is to be noted, that the thicknesses of the material surrounding the contact element in the injection molding process cannot be reduced at will. If there is too much of a reduction of the material surrounding the contact elements the stability of the contacting apparatus is too low. It can also happen, that the support location of the contact element is not completely covered with material during the injection molding process because the thickness of the wall or material is too low. Indeed, the need to fill the mold requires a certain minimum wall thickness for the material enclosing the contact element.

Another problem with the prior art contacting apparatus according to FIG. 4 is the following. The termination portion of the contact element which is located oppositely to the contacting portion of the contact element needs to be deformed i.e. put in a certain form. Such a deformation can be necessary in particular for SMD-soldering terminations so as to achieve the required coplanarity. I.e. the termination portion of the contact element should coextend with the surface of a printed circuit board in a planar manner. Such deformation has to be carried out either prior or after the contact element(s) is (are) mounted by a) injection molding in the contact element support or b) insertion therein. Due to the spring characteristics of the contact element a very precise adjustment and checking during the manufacturing process is required.

It is an object of the present invention to provide a contacting apparatus of the type described above such that the contact element support has a minimal thickness (design height), while at the same time the contact element(s) is (are) well fixed in said contact element support.

It is another object of the invention to provide a contact element support such that it is not necessary to deform said contact element(s) to achieve good coplanarity after the contact element(s) is (are) fixedly mounted in said contact element support.

DISCLOSURE OF THE INVENTION

In one aspect of the present invention a contacting apparatus is provided which comprises a contact element support and at least one contact element, said contact element support being designed such, that it encloses at least one contact element only at locations where forces have to be taken up particularly when at least one contact element is in contacting engagement.

In another aspect of the present invention, the contacting element(s) of the contacting apparatus form(s) a step-like structure separating first and second portions of said contact element support.

BRIEF DESCRIPTION OF THE DRAWINGS

FIG. 1 is a top plan view of a contacting apparatus of the invention mounted on a printed circuit board and adapted to cooperate with a smart card, thus forming a smart card contacting apparatus;

FIG. 2 is a sectional view along line 2—2 in FIG. 1;

FIG. 4 is a sectional view of a contacting apparatus for a smart card in accordance with the prior art.

Initially the prior art will be explained with reference to FIG. 4. FIG. 4 shows a contacting apparatus 1 for a smart card, thus forming a smart card contacting apparatus. The contacting apparatus 1 comprises a plurality of contact elements 2 (only one of which is shown) fixedly mounted in a contact element support 7. Generally, the contact element support 7 is (as shown) mounted on a printed circuit board 11 and termination ends of the contact elements 2 are connected in an electrically conducting manner with the printed circuit board, i.e. for instance at soldering points.

Figure 3:
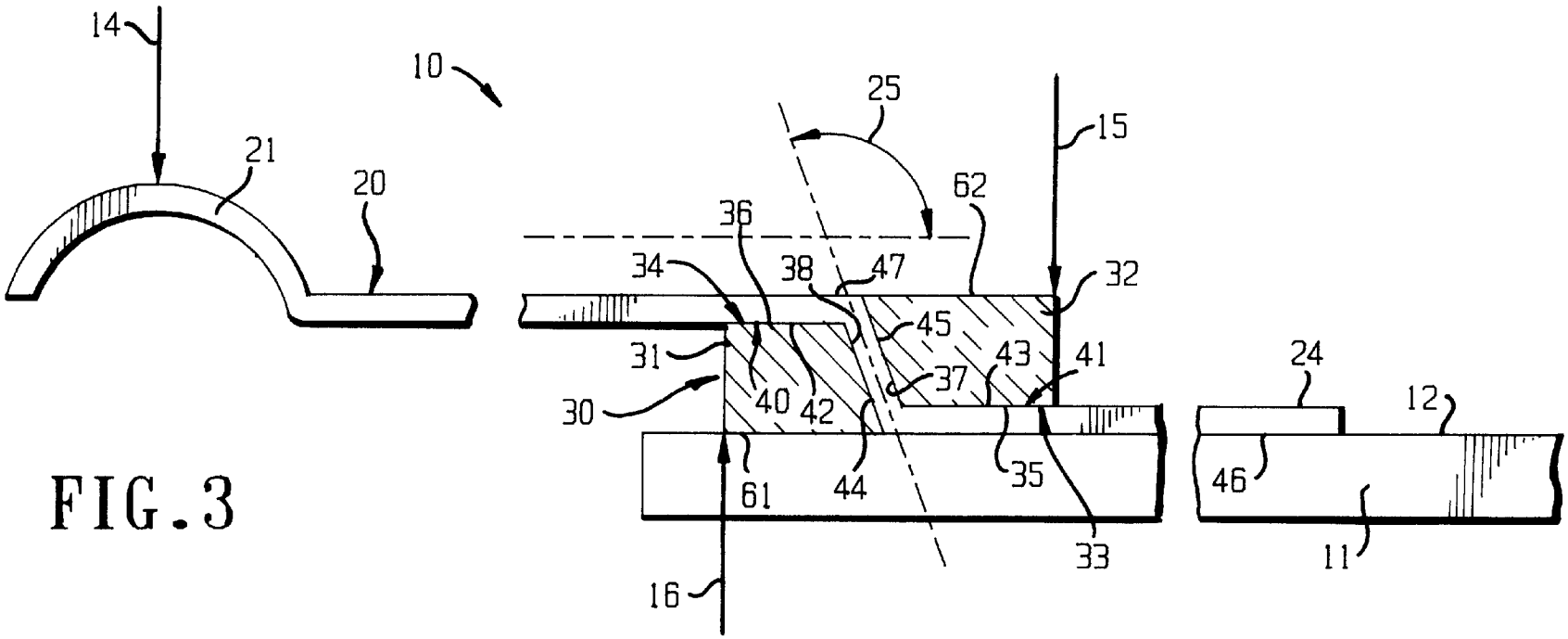
FIG. 3 is an enlarged detail of FIG. 2.

Each of said contact elements 2 comprises a plurality of sections or portions. The contact element 2 of FIG. 4 comprises a contact cusp section 3 a first planar or horizontal section 4, an inclined section 6 and a second planar or horizontal section 5 forming a termination end. In the area of the second planar portion 5 the contact element 2 is connected with the printed circuit board 11.

The first planar section 4 of the contact element 2 is held in a fixed position by the contact element support 7. The contact element support 7 comprises in the area of the contact element 2 an upper portion 8 and a lower portion 9 separated by said contact element 2. The contact element 2 abuts with a part of its bottom surface 19 on a support surface 9*a* of the lower portion 9 of the contact element support 7. A part of the upper surface 18 of the contact element 2 is held by a bottom surface 8*a* of the upper portion 8 of the contact element support 7.

In case a contacting force 14 is exerted onto the contact cusp portion 3 of the contact element 2 (due to a contacting engagement of said cusp portion 3 for instance with a contact pad of a smart card) reaction or take-up forces 16 and 15 will occur at the contact element support 7 and act in opposite directions. Said opposing reaction forces 16 and 15 are also referred to as support forces 15 and 16. In the left or frontal portion (see FIG. 4) of the contact element support 7 the supporting force 16 of the lower portion 9 of the contact element support 7 acts opposite to the contacting force 14. In the right or backward portion (see FIG. 4) of the contact element support 7 the supporting force 15 of the upper portion 8 of the contact element support 7 prevents an upward movement of the contact element 2.

The (total) thickness 13 of the contacting apparatus 1 is the sum of the thicknesses or heights of the contact element 2 and of the upper and lower portions 8 and 9 of the contact element support 7. The thickness of the material of the contact element support 7 (i.e. of the upper and lower portions 8, 9) cannot be selected arbitrarily inasmuch as the required stability might not be obtained. The required stability thus forms a lower limit for the thickness of the contacting apparatus 1.

Continuing with the description of FIG. 4 it is noted that the contact element 2 is bent (deformed) towards the printed circuit board 11 so as to be connected therewith; see the inclined portion 6. The portion 6 of each of the contact elements is formed after the contact element(s) is (are) inserted in the contact element support 7. It is desirable that by means of said inclined portions 6 a precise coplanarity is received for the soldering terminals generally in the area of the second planar portion 5 of the contact element and the printed circuit board 11. Due to the resiliency or spring characteristics of the contact element 2 very precise adjustment and checking steps are necessary during the process of manufacturing.

Referring to FIGS. 1–3 the best mode for carrying out the invention is described.

FIG. 1 discloses a top plan view of a contacting apparatus 10 for a smart card reader or contacting device in accordance with the invention. The contacting apparatus 10 comprises a contact element support 30 and contact elements (i.e. at least one) 20 mounted therein. Between the contact elements 20 the contact element support 30 forms intermediate portions 29. Abutment surfaces 39 of the intermediate portions 29 touch side surfaces 27 of the contact elements 20.

As shown in FIG. 2 the contact element support 30 is divided in the area of the contact elements 20 into first or forward and second or backward portions 31 and 32, respectively. Said forward and backward portions 31 and 32 are coextending with the widths 26 (see FIG. 1) of the contact elements 20.

A mentioned, FIG. 2 shows a sectional view of the contacting apparatus 10 in the area of one contact element 20. As is shown in FIG. 2 the contact element 20 comprises in substance four essential sections or portions: a contact cusp portion 21, a first planar or horizontal portion 22, an inclined or angled portion 23 and a second planar or horizontal portion 24. The angled portion 23 forms together with the planar portions 22, 24 an angle 25 as is shown in FIG. 3.

In the embodiment shown in FIGS. 1–3 the contact element support 30 fixedly supports the contact elements 20 due to the fact, that the plastic material forming the contact element support 30 surrounds the contact elements 20 in respective mounting sections 23 of the contact elements 20 during the injection molding process such, that the contact elements 20 are fixedly mounted in said contact element support 30.

Alternatively (but not shown), the contact elements 20 could be fixedly mounted in the contact support 30 by inserting said contact elements 20 into respective chambers or spaces provided in said contact element support 30.

Continuing with the description of FIGS. 1–3 each contact element 20 comprises, as mentioned above, a mounting section i.e. a section of the contact element 20 where it is supported in the contact element support 30 by a mounting region 28 (FIG. 2), formed by said contact element support 30.

The contact element support 30 is injection molded around the mounting sections 23 of the contact elements 20. As mentioned before, the contact element support 30 forms in an area extending across the widths 26 of the contact elements the mounting regions 28. The mounting regions 28 comprise a first left, frontal or lower mounting region portion 31 and a second, right backward or upper mounting region portion 32.

As can be seen more clearly from FIG. 3 (which is an enlarged detail of FIG. 2) a portion of an upper surface 41 and a portion of a bottom surface 40 of the contact element 20 are in contact with respective abutment or holding surfaces 33 and 34, respectively, of the contact element support 30. In the area of the frontal mounting region portion 31 of the contact element support 30 a support surface 42 of the contact element 20 is in abutment with a support or holding surface 36 of the contact element support 30 and is held by said holding surface 36. In the area of the backward mounting region portion 32 of the contact element support 30 the holding surface 35 of the contact element support 30 holds a portion 43 of the upper surface 41 of the contact element 20. In the area of the angled portion 23 of the contact element 20 an inclined holding surface portion 38 of the frontal mounting region portion 31 supports an inclined portion 44 of the bottom surface 40 of the contact element 20. An inclined supporting surface portion 37 of the mounting region portion 32 holds in that area an inclined portion 45 of the upper surface 40 of the contact element 20.

In the area of the second planar portion 24 of the contact element 20 the lower surface 40 of the contact element 20 abuts with an abutment surface portion 46 on the printed circuit board 11 and is generally in contact with an upper surface 12 of the printed circuit board 11. The abutment surface portion 46, the upper surface 12 of the printed circuit board 11 and a bottom surface 61 of the frontal mounting region portion 31 of the contact element support 30 are preferably coplanar.

Also, a portion 47 of the upper surface 41 of the contact element 20 is coplanar with an upper surface 62 of the rearward portion 32 of the contact element support 30. No contact support material exists above the portion 47 of the upper surface 41 and below the support surface portion 46 of the bottom surface 40 of the contact element 20.

In case a contacting force 14 is exerted onto the contact cusp portion 21 of the contact element 20, a torque is generated about an imaginary axis of rotation in the contact support 30. This torque acts in the direction of the contacting force 14. Opposing or reaction (take-up) forces 16 and 15 act against said torque at the contact support 30 in the frontal area (left in the drawing) of the contact element support 30. The contacting force 14 is opposed by the supporting force 16 of the frontal portion 31 of the contact element support 30. This supporting force 16 is distributed across the support surface portions 36 and 38 of the frontal contact support portion 31. The supporting force 15 which is exerted by the mounting region portion 32 from above onto the contact element 20 is distributed across the support surface portion 35 and 36 of the backward mounting region portion 32.

Due to the fact that different from the prior art as shown in FIG. 4, the contact element 20 is formed with a step, the thickness or height referred to by reference numeral 50 FIG. 2 can be significantly reduced. The contact element 20 of the invention is supported by the contact element support 30 of the invention only in correspondence with the load, i.e. the reaction forces which have to be provided to balance the contacting force 14.

The contact element 20 needs to be supported only at locations where this is necessary, i.e. where due to the contacting force 14 reaction forces have to be provided. In other areas, material of the contact element support 30 can be—compared with what is shown in FIG. 4—removed.

The abutment of the support surfaces 42 and 44 on the support or holding surfaces 36 and 38 prevent the movement of the contact element 20 in that area downwardly (represented by supporting force 16). In the backward portion of the contact element support 30 where, due to the contacting force 14 a force 15 to help balance the force 15 is exerted, the support surfaces 35 and 37 of the backward mounting region portion 32 are in abutment with the support surfaces 43 and 45 of the upper surface 41 of the contact element 20 thus preventing a movement of the contact element 20 upwardly (supporting force 15). In the frontal area of the contact element 20 no contact support material is necessary upwardly of the contact element. Thus, compared with the prior art of FIG. 4 contact support material above the portion 47 of the upper surface 41 of the contact elements 20 can be removed.

As is shown, the first planar portion 22 and the second planar portion 24 and the angled portion 23 of the contact element form the step within the contact element support 30. In this manner, the thickness 50 can be obtained, a thickness which is small as compared with the prior art shown in FIG. 4 inasmuch as the contact elements are supported only in those areas where this is necessary.

It is noted, that the step is designed such, that portion 46 of the lower or bottom surface 40 of the contact element 20 is in contact with the circuit board 11 and also parallel and coplanar to the upper surface 12 after the contacting apparatus 10 is mounted on the printed circuit board 11. Said portion 46 of the bottom surface 40 is parallel or coplanar to the upper surface 12 of the printed circuit board 11 and the lower or bottom surface 61 of the frontal contact support portion 31. That step is fixedly mounted by means of the contact element support 30. A resilient deviation of the contact element 20 in the area of the second planar portion 24 due to spring forces resulting from the deformation is thus no longer possible. This has the advantage, that all contact elements can be designed with their portions 24 coplanar and are fixed in this position by means of said contact element support 30.

Further, by fixedly mounting said step or the inclined portion 23 within the contact element support 30, the contact elements 20 are also anchored and held in their position with respect to transverse movements with respect to the planar portions 22 and 24.

As is clear to a skilled person each contact element 20 could also have more than one step or a continuous shape.

What is claimed is:

1. A contacting apparatus (10) comprising:

a contact element support (30) and fixedly mounted in said contact element support (30) at least one contact element (20), wherein A) said contact element (20) comprises:

a first horizontal portion (22) forming at a free end thereof a contact cusp portion (21), a mounting section (23) adapted to be enclosed by said contacting element support (30), and a second horizontal portion (24) forming at a free end thereof a contacting portion (24), said mounting section (23) forming a step adapted to be located within said contact element support (30); and B) said contact element support (30) being designed such, that it encloses said contact element (20) only in locations where a load is generated by a contacting force exerted onto said contact cusp portion, and forms in the area and across widths (26) of said contacting element (20) a mounting region (28) comprising a first frontal mounting region portion (31) and a second rearward mounting region portion (32) separated by said step of said contact element (20), and wherein said contact element support (30) supports with its first mounting region portion (31) the contact element (20) including its inclined portion (23) from below, and wherein said second mounting region portion (32) of the contact element support (30) supports the contact element inclusive of its inclined portion (23) from above and, wherein in the area of the first horizontal portion (22) of the contact element (20) no contact element support material is provided above the contact element and wherein in the area of a second horizontal portion (24) of the contact element (20) no contact element support material is provided below said contact element.

2. The contacting apparatus of claim 1, wherein a plurality of said contact elements (20) are mounted in said contact element support (30) at the time the contact element support is injection molded.

3. The contacting apparatus of claim 1, wherein said first mounting region portion (31) and the second mounting region portion (32) of the contact element (30) are unitary with an intermediate portion (29) of said contact element support located between said contact elements.

4. The contacting apparatus of claim 1, wherein said step includes an inclined portion (23).

5. The contacting apparatus of claim 4, wherein the step of the contact element (20) is designed such that the contact portion (24) for contacting the printed circuit board (12) is coplanar with an upper surface (12) of the printed circuit board (11) and a bottom surface (61) of the contact element support (30).

6. The contacting apparatus of claim 1, wherein the inclined portion of the step has an angle (25) between 30 and 90 degrees.

7. The contacting apparatus of claim 1, wherein said contacting portion 24) is adapted to contact a printed circuit board (11).

8. The contacting apparatus according to claim 1, wherein the first horizontal portion and the second horizontal portion are planar.

* * * * *